United States Patent [19]

Thompson

[11] 4,317,493

[45] Mar. 2, 1982

[54] KELLY DRIVE BUSHING ADAPTER

[76] Inventor: Derry R. Thompson, 2826 Redwood Pl., Anchorage, Ak. 99504

[21] Appl. No.: 109,492

[22] Filed: Jan. 4, 1980

[51] Int. Cl.[3] ..... E21B 7/08; E21B 3/06

[52] U.S. Cl. ..... 175/87; 64/23.5; 166/65 R; 175/45; 175/103; 175/195; 173/165

[58] Field of Search ..... 175/44-46, 175/87, 103-105, 195; 166/65 R, 66; 64/23.5, 23.6, 23.7; 173/165

[56] References Cited

U.S. PATENT DOCUMENTS 3,007,534 11/1961 Salnikov et al. ..... 175/104
3,038,547 6/1962 Deely ..... 64/23.5

FOREIGN PATENT DOCUMENTS 636,790 2/1962 Canada ..... 64/23.6

*Primary Examiner*—Ernest R. Purser
*Attorney, Agent, or Firm*—William D. Stokes

[57] ABSTRACT

An adapter is provided for positioning a kelly drive bushing of a surface drilling assembly in spaced relationship to an associated rotary table. The adapter permits the wireline of an electronic steering assembly to pass through the central aperture in the rotary table below the drive bushing to surface readout equipment, enabling the electronic steering assembly to be employed for drilling directional bores without removal of the kelly.

10 Claims, 8 Drawing Figures

KELLY DRIVE BUSHING ADAPTER

BACKGROUND OF THE INVENTION

In drilling directional bores in the earth, as for gas or oil wells, it is necessary to establish as accurately as possible the deviated course to be followed and to orient the down-hole tools to maintain this course. Further, the ultimate horizontal displacement of the borehole must be accomplished by smooth, gradual course changes in order to facilitate the smooth casing of the borehole to complete the well.

The rig system conventionally employed comprises a surface drilling assembly and a down-hole assembly including a pipe string of drill pipe sections supporting a distal drilling assembly comprising a drill collar weighting a rotational drill bit, and an orienting sub and bent sub which establish the angle of deflection of the drill bit. The down-hole assembly for directional bores further typically includes a down-hole motor such as a mud motor which drives the drill bit and which is operated by drilling fluid circulating within the pipe string; the use of the mud motor thereby obviates rotatonal motion of the entire down-hole assembly which would further complicate the engineering of the directional bore.

Originally, the desired course of the directional bore was established by the "single-shot" survey method wherein a survey is made on each section (usually 30 ft.) of drill pipe as it is drilled down into the borehole, and the drilling assembly reoriented as required. Dissatisfaction with the time-consuming nature of this method and its inaccuracy in deeper boreholes led to the development of an electronic steering system for surveying and orienting the drilling assembly under dynamic (drilling) conditions. The steering system typically includes a down-hole tool or probe which engages within the orienting sub and transmits bottom-hole survey and orientation information such as tool setting ("toolface"), hole angle, and hole direction to surface readout equipment via electronic impulses along a wire line or "logging line" contained within the pipe string. By correcting aberrant deflections of the drill bit reflected in the surface readout equipment, proper torque balance of the down-hole assembly may thus be obtained, and the directional borehole drilled more smoothly and accurately than previously possible.

With the advent of the electronic steering system, revision of the conventional surface drilling assembly was necessary to accommodate the wire extending through the pipe string to the surface readout equipment. Previously, the surface drilling assembly included a kelly or hollow drive shaft, of the type described in U.S. Pat. No. 3,848,684 to West, selectively engaged with a rotary table by a kelly drive bushing disposed on the table so that rotary motion of the table is imparted to the kelly. In this assembly, the kelly is releasably engaged with the upper end of the drill pipe string so that the bore of the kelly communicates at one end thereof with the drill pipe string, and at the other end thereof with a kelly hose which is a conduit for drilling fluid contained in storage devices such as tanks. In operation, the drilling fluid is pumped from storage through the kelly hose, the kelly, and through the drill pipe string to operate the down-hole motor. After exiting through the drill bit, the fluid then rises through the annular space between the pipe string and the bore hole to the surface where it is collected and directed to the storage tank, via a flowline, for recirculation.

With the electronic steering system, it is necessary to "pack off" or seal the wireline, to prevent the escape of drilling fluid at the point where the wireline diverges from the drill pipe string to the surface readout equipment. Since the wireline cannot be run through the kelly and then packed off, in order to use the electronic steering system with circulating drilling fluid, it has heretofore been necessary to remove the kelly from the surface drilling assembly and replace it with a pack-off unit at the top of the drill pipe string. This is done by removing the kelly hose after circulation of the drilling fluid has been halted, replacing the kelly with a pack-off unit, running the wireline through the pack-off unit, and attaching the kelly hose to the unit. Drilling fluid can then be circulated after the pack-off is tightened about the wireline.

Removing the kelly from the line in this manner has several disadvantages. For one, it is time-consuming, and for another, it is hazardous to the drilling operation, as with the cessation of circulation of the drilling fluid and the necessary location of the drilling assembly within about ten feet of the bottom of the hole during the operation, the potential for the drilling assembly to become firmly lodged in the hole greatly increases. Further, in typical drilling rigs, only ninety feet of hole can be drilled after the kelly is replaced, since the derricks employed can only hoist ninety feet of drill pipe above the surface because of limitations imposed by the length of the kelly hose and associated conduit for the drilling fluid. Thus, when the packed-off drill pipe has been drilled down, the entire operation must again be halted while the fluid circulation is stopped, the pack-off unit removed, the wireline pulled, and more pipe added on the string.

While the system has been improved by the development of the side-entry sub of the type described in U.S. Pat. No. 4,062,551, this innovation has still not permitted retention of the kelly in place in the surface drilling assembly simultaneously with the employment of the electronic steering system. A hollow cylindrical component of the drill pipe string, the side-entry sub is customarily engaged with the uppermost section of the drill pipe at the rotary table and is adapted to receive the wireline through a radially extending bore or channel in the side-entry sub. The wireline can then be packed-off where it enters the side-entry sub and the drilling can proceed uninterrupted as the wireline is extended within the borehole annulus adjacent the pipe string to the desired length, without the necessity of periodically pulling the wireline to add further sections of drillpipe.

Notwithstanding this advantage, it has not been possible to employ the kelly in conjunction with the side-entry sub owing to the path the wireline follows after exiting the side-entry sub. Typically, at present, the wireline passes to the surface of the borehole from the side entry sub alongside the pipe string, to which it is secured at intervals, through an aperture in the center of the rotary table to a sheave or pulley associated with the derrick, and from there to the wireline unit and then to the surface readout equipment. With the kelly drive bushing disposed in its usual position on the rotary table, the wireline would be cut or damaged by the bushing, with resultant steering system failure. Accordingly, the kelly is not presently used with the side-entry sub, and as a result, the use of the electronic steering system even with the side-entry sub necessitates the removal of the kelly with the accompanying removal and reconnection of the kelly hose while the drill assembly is on bottom, with the attendant risks and delays described supra. Further, the absence of the kelly makes it more difficult to apply torque to the drill pipe string as necessary, for example, to correct the orientation of the drilling assembly when the mud motor is being employed.

Accordingly, it is an object of the invention to provide means for adapting a kelly drive bushing to accommodate a steering system wireline without appreciably endangering the integrity of the wireline.

It is a further object of this invention to provide means for adapting a kelly drive bushing to accommodate a steering system wireline to permit the concurrent use of an electronic steering system and a kelly and kelly drive bushing in the directional drilling of a borehole.

It is another object of this invention to provide means for adapting a kelly drive bushing to safely accommodate a steering system wireline, which means are removably engageable with the kelly drive bushing whether or not the kelly is engaged with the drill pipe string.

It is a further object of this invention to provide means for adapting a kelly drive bushing to accommodate a steering system wireline which will permit the kelly and kelly drive bushing to freely rotate as necessary to engage added sections of drill pipe without entangling of the steering system wireline.

It is also an important object of this invention to provide means for adapting a kelly drive bushing to safely accommodate a steering system wireline to obviate the necessity for periodic removal of the kelly during the drilling of directional bores with the aid of an electronic steering system and the associated necessity of removal and reconnection of the kelly hose to the pack-off unit which customarily replaces the kelly in the surface drilling assembly.

It is yet another object of this invention to provide means for adapting a kelly drive bushing to accommodate a steering system wireline without interruption of drilling fluid circulation during installation thereof.

Further objects and advantages of the invention will be apparent from the following description and drawings.

SUMMARY OF THE INVENTION

The invention comprises a kelly drive bushing adapter for retaining a kelly drive bushing in spaced relationship to a rotary table in operative engagement therewith, to permit the steering assembly wireline to safely pass through the central aperture in the rotary table and below the kelly drive bushing to the surface readout equipment.

DETAILED DESCRIPTION OF THE INVENTION

Figure 1:
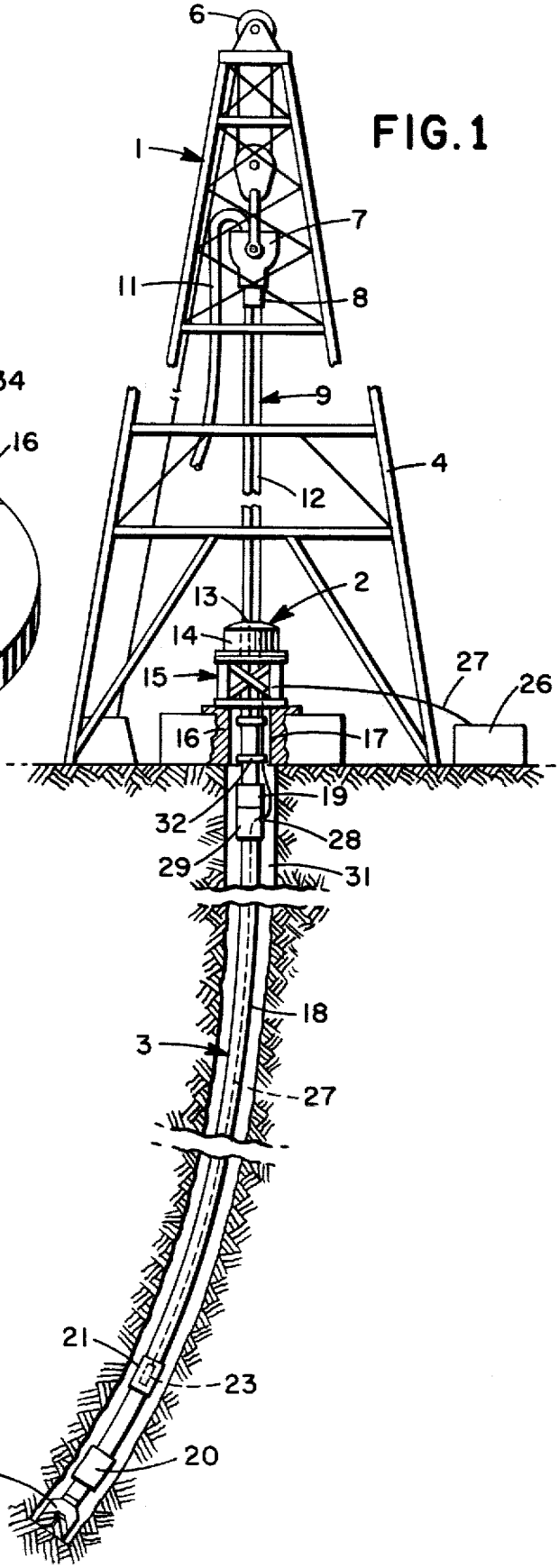
FIG. 1 is a side elevational view, partially in section, of a drilling rig with the drive bushing adapter of this invention shown in place; in conjunction with the associated drill line and down-hole assembly.

In FIG. 1, the drilling rig generally indicated by the numeral 1 includes a surface drilling assembly generally indicated at 2 and a down-hole assembly generally indicated at 3. The surface drilling assembly includes a derrick 4, draw works 5, a crown block 6 and a swivel 7 to which is attached the uppermost portion 8 of a kelly 9 having a longitudinally extending bore (not shown) communicating with a kelly hose 11 at the uppermost portion 8. The drive section 12 of the kelly 9 is non-circular in cross-section and conforms to an opening 13 longitudinally extending through a kelly drive bushing 14 slidably disposed on the kelly drive section 12 for rotational engagement therewith. The surface drilling assembly further includes a rotary table 16 having a central aperture 17 through which extends the kelly drive section 12. The kelly drive bushing 14 is maintained in spaced relationship to the rotary table 16 by the kelly drive bushing adapter of the invention, generally indicaed at 15. Motion imparted to the rotary table 16 by drilling machinery (not shown) is thus transmitted to the kelly 9, the kelly drive bushing 14, and the adapter 15.

The down-hole assembly 3 includes a drill pipe string 18 threadably engaged with the lowermost portion 19 of the kelly 9, terminated in a drilling assembly including a mud motor 20, an orienting sub 21, and a drill bit 22. Axially contained within the orienting sub is an electronic probe 23 of a steering assembly system generally indicated at 24. The steering assembly further includes a surface readout device 26 electrically connected to the probe 23 by a wireline 27. The wireline 27 is contained within the axial bore of the distal portion of the drill pipe string 18 until it exits the pipe string 18 through a radial bore 28 in a side-entry sub 29 threadably engaged between sections of the drill pipe string 18. After passing through the radial bore 28 in the side-entry sub 29, the wireline 27 ascends the borehole annulus 31 alongside the pipe string 18, secured to the pipe-string at intervals by securing means such as a securing strap 32. The wireline 27 emerges from the borehole and passes through the central aperture 17 in the rotary table 16. Owing to the presence of the adapter 15 spacing the kelly drive bushing 14 from the rotary table 16, the wireline 27 freely passes through the central aperture 17, below the drive bushing 14, through adapter 15 to the surface readout device 26.

Figure 2:
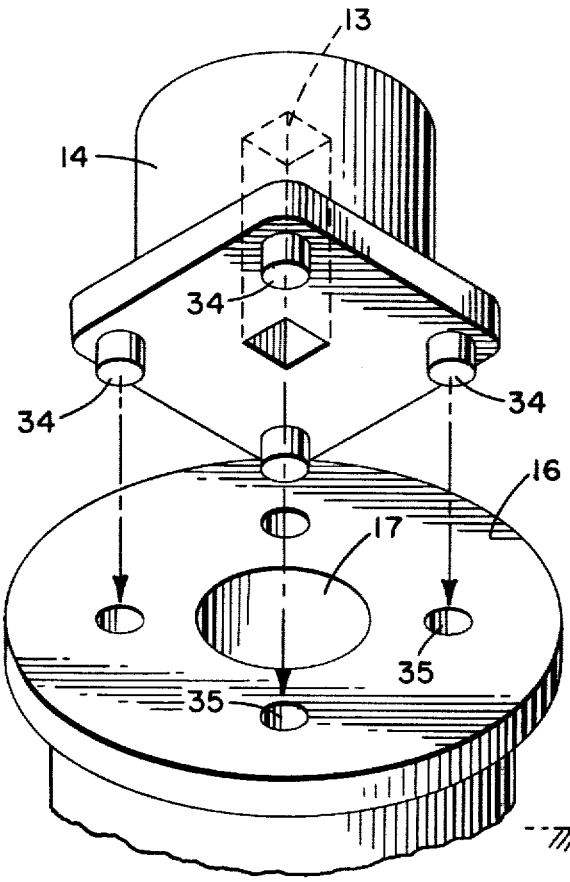
FIG. 2 PRIOR ART
FIG. 2 is an exploded perspective view of a kelly drive bushing and rotary table of a conventional drilling assembly.

As shown in FIG. 2, in a conventional surface drilling assembly 2, the kelly drive bushing 14 is directly seated on the rotary table 16 and secured thereto by rotary table engaging drive pins 34 for engaging the bushing 14 with the table 16 for rotation therewith. Various rotary table engaging means are in use, such as drive pins 34 disposed on the base of the bushing 14 for engagement in corresponding apertures 35 of the rotary table 16. Alternatively, as shown in FIG. 3, the rotary table engaging means may comprise an external non-circular boss 36 on the bushing 14 adapted for mating with a corresponding non-circular aperture 37 (which corresponds to hole 17 of FIG. 2) in the upper surface of the rotary table 16.

Figure 4:
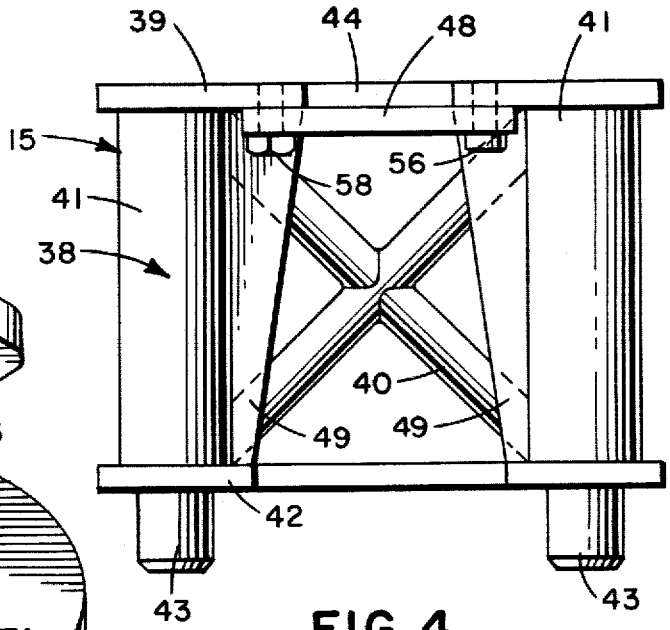
FIG. 4 is a side elevational view of the drive bushing adapter of this invention.

As best seen in FIG. 4, the adapter 15 of the invention comprises a framework 38 including a preferably substantially square top-plate 39 measuring, for example, two feet on a side, having means for spacing the bushing 14 from the table 16, such as four vertical posts 41 between top plate 39 and base plate 42. Pins 43 depend from base plate 42 for engaging apertures 35 of the rotary table 16 shown in FIG. 2. Diagonal braces 40 between posts 41 strengthen the frame, as do the gusset plates 49 on the entrance side of the adapter.

Figure 5:
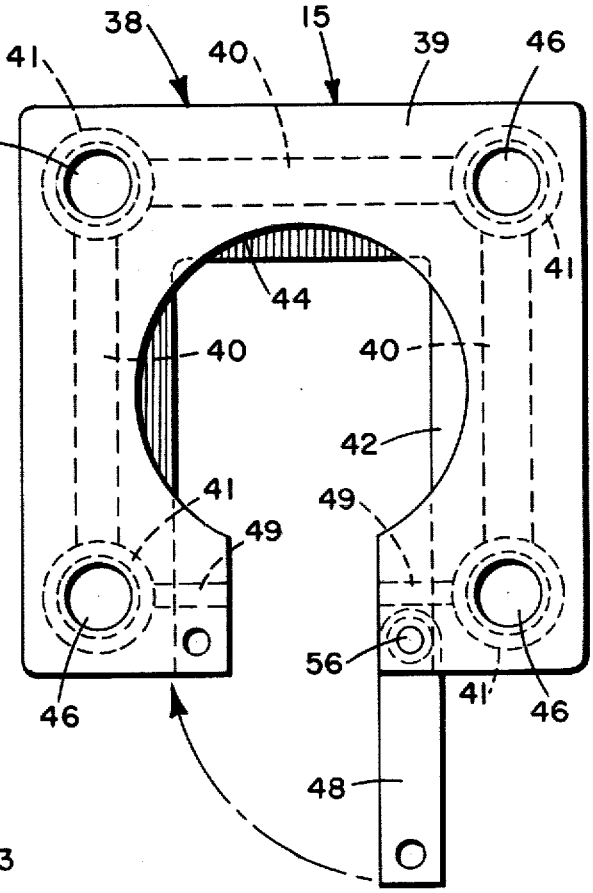
FIG. 5 is a top plan view of the adapter shown in FIG. 4.
Figure 7:
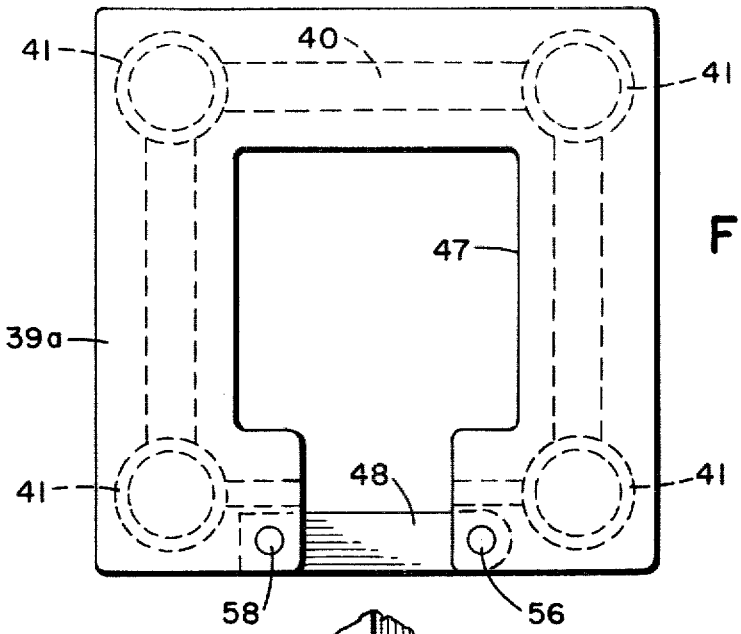
FIG. 7 is a top plan view of an alternate embodiment of the adapter.
Figure 8:
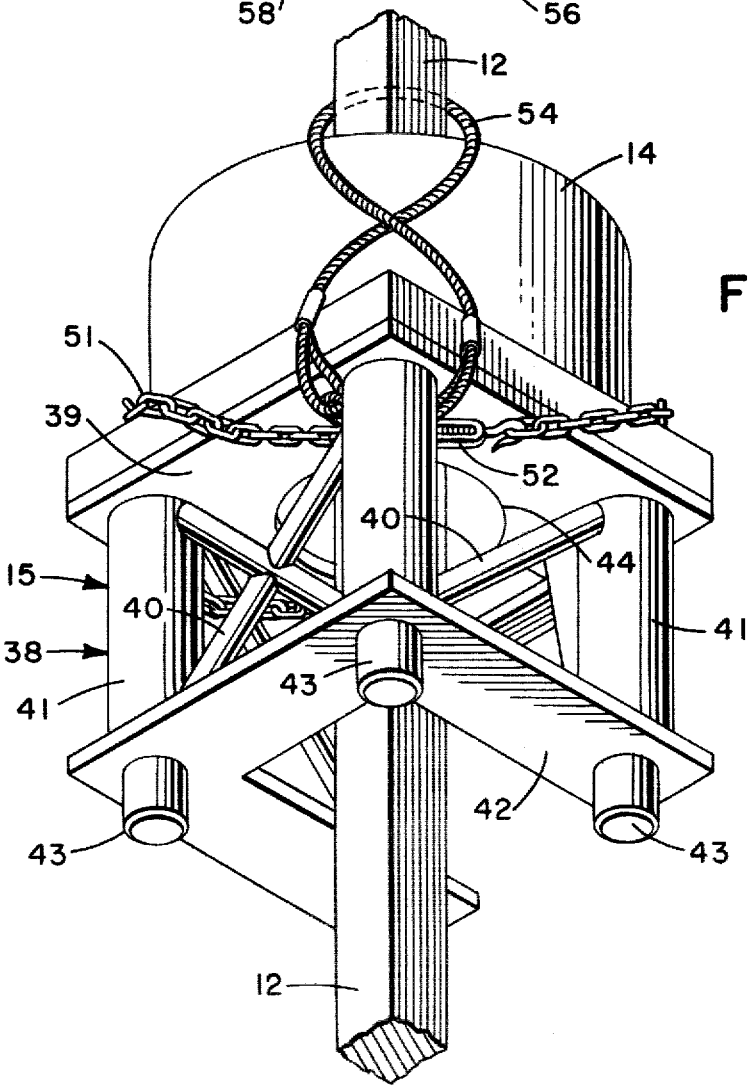
FIG. 8 is a perspective view of the assembly of the drive bushing and adapter.

As shown in FIG. 5, the top-plate 39 of the kelly drive bushing adapter 15 includes a keyhole aperture 44 shaped for slidable engagement with the drive bushing 14 so that the adapter 15 may be placed in operative position on the rotary table 16 from the side without disengaging the kelly 9 from the drill pipe string 18. The top-plate 39 further includes drive bushing engaging means such as apertures 46 for receiving the bushing drive pins 34 so that rotary movement of the table 16 is imparted to the adapter 15 and the bushing 14.

Figure 3:
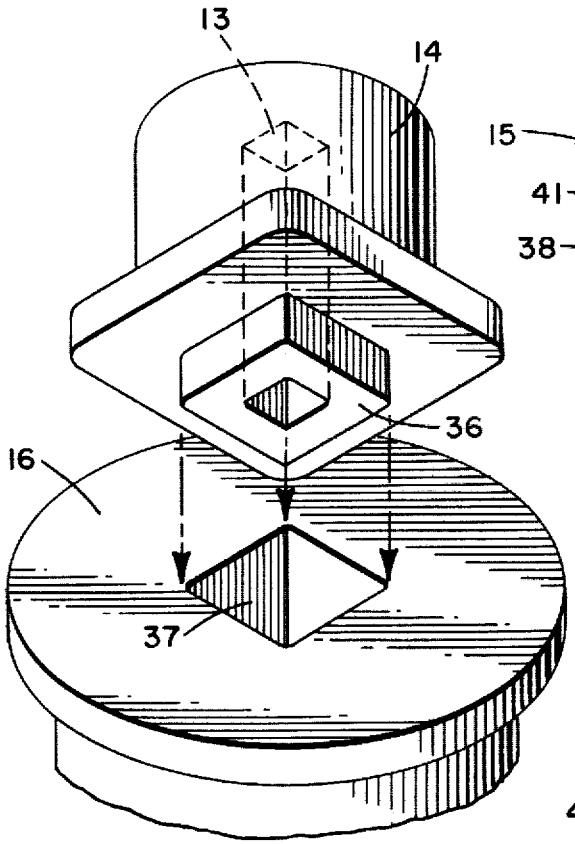
FIG. 3 PRIOR ART
FIG. 3 is an exploded perspective view of another embodiment of a drive bushing-rotary table assembly.
Figure 6:
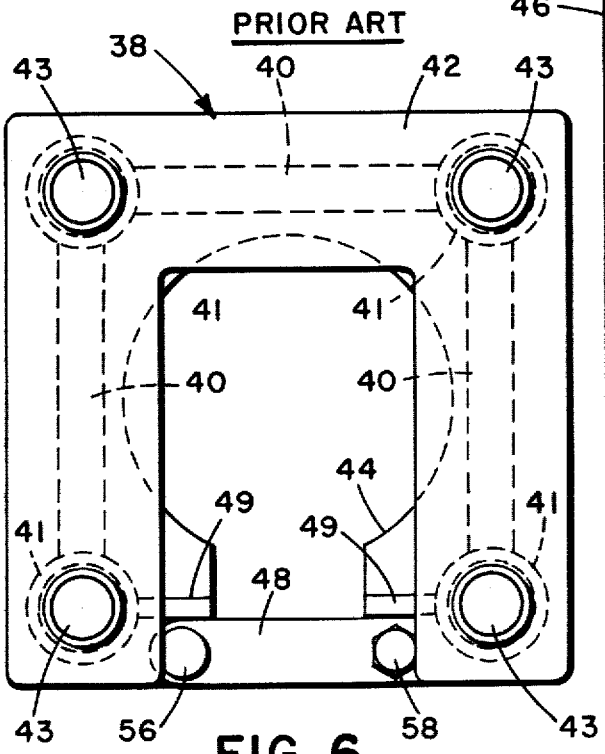
FIG. 6 is a bottom plan view of said adapter.

As illustrated in FIG. 6, the top-plate **39*a* includes bushing receiving means comprising a receiving opening or recess 47 adapted to receive the external non-circular base surface 36 of the bushing 14 of FIG. 3. It will be necessary in this case to provide suitable flanges (not shown) on the base plate 42 to engage the non-circular aperture 37** in the rotary table.

The top-plates 39 and **39*a* further include closure means such as a hinged bar 48 for closing the keyhole aperture 44 or receiving recess 47 after the adapter 15 is placed in position around the kelly 9 to secure the adapter 15 around the kelly 9. The bar 48 is pivoted about pin 56 and secured in a closed position by a screw 58. Adapter 15 is desirably secured to the drive bushing 14 by a chain 51 wrapped about the corners of the top-plate 39 and the base plate of the drive bushing 14 and tightened by a turn-buckle 52 (FIG. 4). The securing means should further include a safety cable 54 to ensure the safety of bystanders and to maintain drive pins 34 in engagement with adapter 15. Other means for securing the drive bushing to the adapter 15** could, of course, be employed.

In operation, the borehole is drilled to the kick-off depth, and the drilling assembly including the mud motor 20, the orienting sub 21 and the drill bit 22 are run to the bottom. The side entry sub 29 is made up at the rotary table 16 and threadably engaged between the uppermost portion of the drill pipe string 18 and the lowermost portion 19 of the kelly 9, which is slideably engaged within the kelly drive bushing 14. The bushing 14 is spaced about 1½ feet from the rotary table 16 by the adapter 15. The side-entry sub 29 is packed-off, and the wireline 27 in place through the central aperture 17 in the rotary table 16, leads under the drive bushing 14 to the surface readout device 26. Drilling then proceeds as usual. As sections of drill pipe need to be added, it is merely necessary to rotate the kelly 9, with accompanying rotation of the drive bushing 14, the framework 38, and the rotary table 16, sufficiently to thread an additional pipe section to the drill pipe string 18.

When it is desired to remove the adapter 15 to reattach the bushing 14 to the table 16, the closure means such as hinge 48 is opened and the adapter 15 slideably disengaged from the bushing 14 by disengaging the rotary table engaging means 33 from the bushing receiving means 45 and by disengaging the adapter table engaging means 42 from the rotary table 16. The kelly drive bushing 14 is reattached to the rotary table 16 by sliding the bushing 14 downward on the kelly 9 and engaging the rotary bushing engaging pins 34 or non-circular boss 36 with the corresponding elements such as apertures 35 or non-circular recess 37. The adapter 15 is similarly reattached without the necessity of uncoupling the kelly 9 from the pipe string 18, thus permitting continual circulation of drilling fluid during attachment or detachment of the adapter 15. Further, if a mud motor 20 is being employed, the operation can continue during attachment and detachment. The wireline is used only when the mud motor is in the drill string, at which time the drill string is not, so to speak, being fuly rotated. The rotation applied to the drill string at that time is only that which is sufficient to deflect the hole and "face the tool" in the desired orientation or direction. While the maximum rotation in the hole is 180°, because of torsional yield or strength of the drill string, slightly more rotation may have to be applied at the surface to gain the required torque or turn of the mud motor at deeper depths. Once the steering tool probe is run in the drill string and seated in the orientation sub, the pack off in the side entry sub is tightened. This pack off not only stops any fluid leakage but also supports the weight of the wireline thus permitting the wireline above the table to be "slacked off" or loosened so that small amounts of rotation of the drill string may occur without damage to the wireline. Additionally, there is no necessity to remove the adapter 15 when additional pipe is added to the pipe string 18, as the adapter 15 will move with the bushing 14 as the pipe is inserted, as previously explained.

What is claimed is:

1. In a surface drilling assembly of the type employing in drilling boreholes in the earth and of the type including a kelly slideably engaged on a kelly drive bushing for rotation therewith and a rotary table for imparting rotary motion to the kelly and kelly drive bushing, said rotary table having a central aperture in axial alignment with the kelly through which the kelly is driven, the improvement comprising an adapter including spacing means for spacing the kelly drive bushing from the rotary table aperture, bushing engaging means for engaging the bushing for rotation therewith, adapter table engaging means for engaging the rotary table for rotation therewith so that the drive bushing is maintained in spaced relationship to the rotary table and rotated therewith and an entrance opening extending through at least one side of the adapter to permit a wireline of an electronic steering assembly of the type employed in drilling directional bores to freely and safely pass between the kelly and the central aperture in the rotary table and through the adapter below the kelly drive bushing to associated surface readout equipment.

2. The invention of claim 1, wherein the kelly drive bushing is of the type having drive pins for engaging the rotary table and the adapter bushing engaging means comprise corresponding receiving apertures for receiving the drive pins.

3. The invention of claim 1, wherein the kelly drive bushing is of the type having a non-circular external surface for mating engagement with a corresponding recess in the rotary table, and the adapter bushing engaging means comprise a corresponding receiving recess for receiving the non-circular external surface.

4. The invention of claim 1, wherein the adapter comprises a framework including a top-plate having adapter bushing engaging means and adapter table engaging means spaced from the top-plate by vertical spacing elements.

5. The invention of claim 4, wherein the top-plate includes a keyhole opening for lateral slideable engagement with the kelly drive bushing.

6. The invention of claim 5, wherein the adapter bushing engaging means comprises a recess or aperture in the top-plate corresponding to a non-circular external surface of the kelly drive bushing, and the adapter table engaging means comprises a pin disposed at the base of each of the vertical spacing elements receivable in corresponding recesses in the rotary table.

7. The invention of claim 5, wherein the adapter bushing engaging means comprise a plurality of apertures in the top-plate for receiving corresponding drive pins in the kelly drive bushing.

8. The invention of claim 5 wherein the adapter further includes closure means for closing the keyhole opening after the adapter is engaged with the drive bushing.

9. The invention of claim 8, wherein the adapter further includes locking means for locking the framework to the bushing, and the framework is cross-braced.

10. The invention of claim 9, wherein the locking means comprises a plurality of clamps.

* * * * *